US007716922B2

(12) United States Patent
Ehlers

(10) Patent No.: US 7,716,922 B2
(45) Date of Patent: May 18, 2010

(54) DIESEL PARTICULATE FILTER (DPF) IN-CHASSIS CLEANING METHOD

(75) Inventor: Mark S. Ehlers, Fort Wayne, IN (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 846 days.

(21) Appl. No.: 11/551,475

(22) Filed: Oct. 20, 2006

(65) Prior Publication Data

US 2008/0092525 A1 Apr. 24, 2008

(51) Int. Cl.
*F01N 3/00* (2006.01)

(52) U.S. Cl. ..... 60/295; 55/523; 134/1; 134/12; 134/17; 134/18; 134/22.11

(58) Field of Classification Search ..... 95/178–280; 60/285, 286; 55/523; 134/1, 22.12, 22.18, 134/17

See application file for complete search history.

(56) References Cited

U.S. PATENT DOCUMENTS

| | | | |
|---|---|---|---|
| 3,816,981 | A | 6/1974 | Carnewal et al. |
| 3,837,150 | A | 9/1974 | Kubiak |
| 3,936,902 | A | 2/1976 | Shackleton et al. |
| 4,222,755 | A | 9/1980 | Grotto |
| 4,242,115 | A | 12/1980 | Harold et al. |
| 4,266,953 | A | 5/1981 | Matthys et al. |
| 4,331,459 | A | 5/1982 | Copley |
| 4,359,330 | A | 11/1982 | Copley |
| 4,364,751 | A | 12/1982 | Copley |
| 4,485,622 | A | 12/1984 | Takagi et al. |
| 4,514,193 | A | 4/1985 | Booth |
| 4,544,389 | A | 10/1985 | Howeth |
| RE32,185 | E | 6/1986 | Copley |
| 4,661,131 | A | 4/1987 | Howeth |
| 4,690,700 | A | 9/1987 | Howeth |
| 4,830,642 | A | 5/1989 | Tatge et al. |
| 5,052,178 | A | 10/1991 | Clerc et al. |
| 5,156,660 | A | 10/1992 | Wilson |
| 5,195,318 | A | 3/1993 | Shinzawa et al. |

(Continued)

FOREIGN PATENT DOCUMENTS

| | | |
|---|---|---|
| EP | 0 471 186 A1 | 7/1991 |

(Continued)

OTHER PUBLICATIONS http://www.thefreedictionary.com/explode, Sep. 18, 2009.*

(Continued)

*Primary Examiner*—Thomas E Denion
*Assistant Examiner*—Jesse Bogue
(74) *Attorney, Agent, or Firm*—Jeffrey P. Calfa; Mark C. Bach

(57) ABSTRACT

A diesel particulate filter of a motor vehicle is cleaned of ash, typically using equipment already available in a service shop. The method of the invention cleans ash particles from the diesel particulate filter by generating a pressure wave and transmitting the pressure wave into a housing containing the diesel particulate filter. The pressure wave dislodges ash particulates from the filter, which can then be removed from the filter using an ash collecting apparatus, such as a shop vacuum. The method also uses an inflatable bladder in the filter apparatus to close access between the housing and the engine or outside environment.

2 Claims, 4 Drawing Sheets

U.S. PATENT DOCUMENTS

| | | | | |
|---|---|---|---|---|
| 5,253,476 | A | 10/1993 | Levendis et al. | |
| 5,395,409 | A | 3/1995 | Klimczak et al. | |
| 5,401,285 | A | 3/1995 | Gillingham et al. | |
| 5,426,936 | A | 6/1995 | Levendis et al. | |
| 5,516,426 | A | 5/1996 | Hull et al. | |
| 5,575,826 | A | 11/1996 | Gillingham et al. | |
| 5,584,913 | A | 12/1996 | Williams | |
| 5,616,171 | A | 4/1997 | Barris et al. | |
| 5,683,479 | A | 11/1997 | Gillingham et al. | |
| 5,725,618 | A | 3/1998 | Shimoda et al. | |
| 5,837,017 | A | 11/1998 | Santschi et al. | |
| 5,895,521 | A | 4/1999 | Otsuka et al. | |
| 6,004,382 | A | 12/1999 | Pikesh et al. | |
| 6,010,547 | A | 1/2000 | Jeong et al. | |
| 6,022,388 | A | 2/2000 | Andersson et al. | |
| 6,123,778 | A * | 9/2000 | Quitberg | 134/8 |
| 6,304,815 | B1 | 10/2001 | Moraal et al. | |
| 6,309,447 | B1 | 10/2001 | Felix | |
| 6,464,744 | B2 | 10/2002 | Cutler et al. | |
| 6,594,990 | B2 | 7/2003 | Kuenstler et al. | |
| 7,462,222 | B2 * | 12/2008 | Sellers et al. | 95/279 |
| 2004/0103788 | A1 | 6/2004 | Streichsbier et al. | |

FOREIGN PATENT DOCUMENTS

| | | |
|---|---|---|
| WO | WO 98/34713 | 8/1998 |

OTHER PUBLICATIONS

U.S. Appl. No. 11/382,103, filed May 8, 2006, Cook.
U.S. Appl. No. 11/328,946, filed Jan. 10, 2006, Ehlers.
U.S. Appl. No. 11/246,351, filed Oct. 7, 2005, Ehlers.

* cited by examiner

DIESEL PARTICULATE FILTER (DPF) IN-CHASSIS CLEANING METHOD

BACKGROUND OF THE INVENTION

1. Field of the Invention

The present invention relates to apparatuses and methods for cleaning a diesel particulate filter while installed in the chassis of a motor vehicle.

2. Description of the Prior Art

Diesel engines are efficient, durable and economical. Diesel exhaust, however, can harm both the environment and people. To reduce this harm governments, such as the United States and the European Union, have proposed stricter diesel exhaust emission regulations. These environmental regulations require diesel engines to nearly meet the same pollution emission standards as gasoline engines.

One part of diesel exhaust includes diesel particulate material. Diesel particulate material is mainly carbon particles or soot. One way to remove soot from diesel exhaust is with diesel traps. The most widely used diesel trap is a diesel particulate filter which nearly completely filters the soot without hindering exhaust flow. As a layer of soot collects on the surfaces of the inlet channels of the filter, the lower permeability of the soot layer causes a pressure drop in the filter and a gradual rise in the back pressure of the filter against the engine. This phenomenon causes the engine to work harder, thus decreasing engine operating efficiency. Eventually, the pressure drop in the filter and decreased engine efficiency becomes unacceptable, and the filter must either be replaced or the accumulated diesel soot must be cleaned out.

The filter is cleaned of accumulated diesel soot by burning-off or oxidation of the diesel soot to carbon dioxide which is known as regeneration. Regeneration of an existing filter is superior to filter replacement, because no interruption for service is necessary.

In addition to capturing carbon soot, the filter also traps ash particles, such as metal oxides, that are carried by the exhaust gas. These particles are not combustible and, therefore, are not removed during regeneration. The filter must therefore be cleaned or discarded when the ash particles in the filter build up to high levels.

Cleaning ash from a diesel particulate filter is not easily accomplished with typical maintenance shop equipment. The use of shop air to blow out the ash particles does not lend itself to containment of the ash particles. The use of a wet/dry vacuum tool has limited effectiveness on smaller and deeply embedded particles. The use of water or solvents can be detrimental to the substrate and/or washcoat.

Several methods of cleaning the filter require the removal of the filter from the chassis and insertion into specialized equipment for cleaning. These methods expose the heavy filter to excessive handling which increases the potential for inadvertent damage to this expensive component. The equipment is also expensive to purchase for the service shop, which would make the cost of cleaning expensive for the motor vehicle owner.

Therefore, it would be advantageous to develop a method to quickly and easily clean the ash particles from the filter while still attached to the chassis. It would be further advantageous to clean the filter without using costly additional or specialized equipment.

SUMMARY OF THE INVENTION

According to the invention there is provided an economical way of cleaning the ash from a diesel particulate filter of a motor vehicle. The method of the invention cleans ash particles from the diesel particulate filter by producing a pressure wave and introducing the pressure wave into a housing containing the diesel particulate filter. The pressure wave dislodges ash particulates from the filter, which can then be removed from the filter using a suction device, such as a shop vacuum.

The method cleans the filter apparatus while the apparatus is still attached to a chassis of the motor vehicle and engine. The diesel particulate filter is disposed within a housing. A first conduit is in fluid communication with the engine and the housing and has a port. A second conduit is in fluid communication with the housing and can have a second port. An inflatable bladder is bladder located in one of the conduits and accessible through one of the ports.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
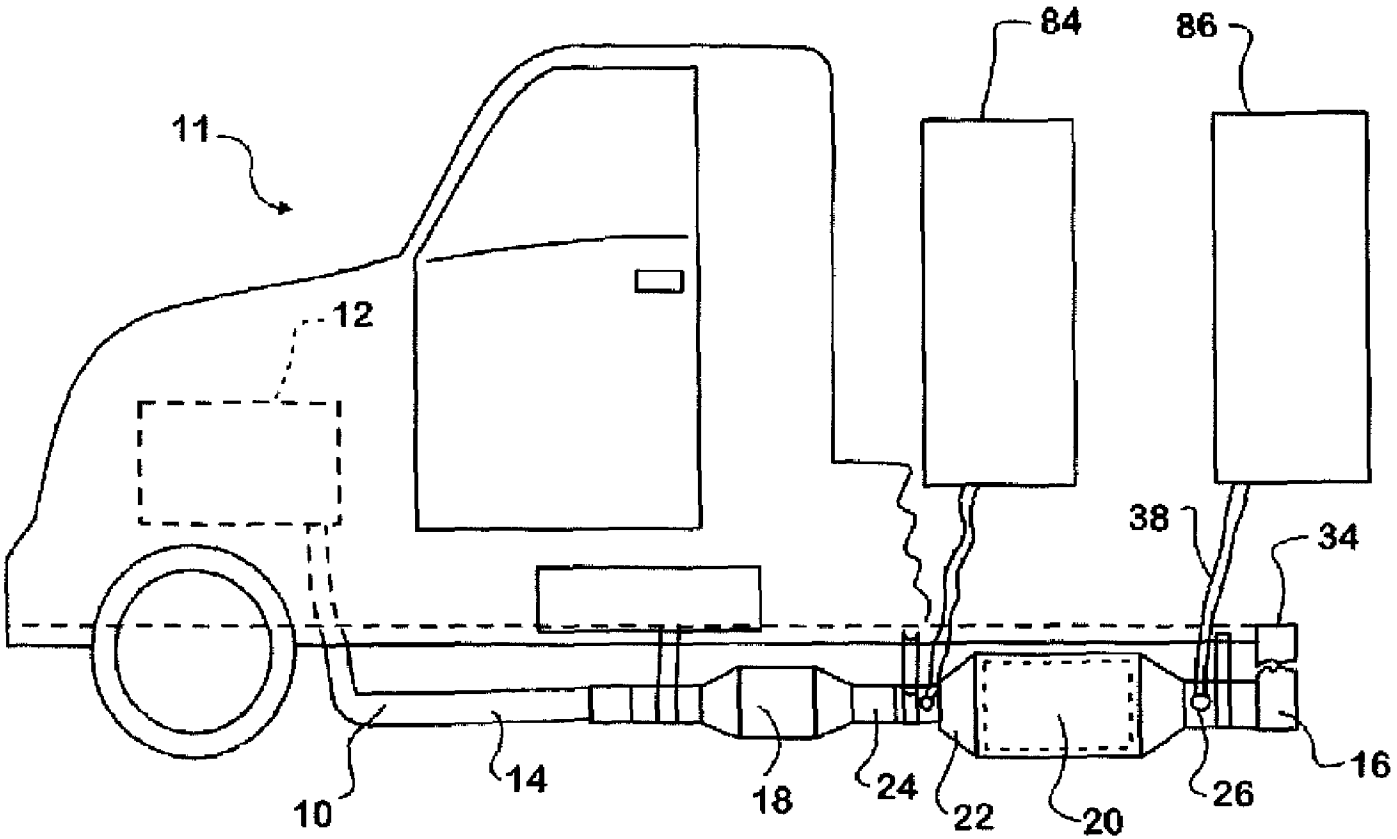
FIG. 1 is a side view of a motor vehicle with the filter apparatus and pressure wave generator of the invention.

Turning to the Figures where like reference numerals refer to like structures, the present invention relates to a method and apparatus for cleaning ash from a diesel particulate filter 20 which can be used while the diesel particulate filter 20 still attached to the motor vehicle 11 or truck, such as to the chassis, or used after removal of the diesel particulate filter 20 and housing 22. The filter apparatus 10 can be installed on the motor vehicle 11 is any configuration, such as vertically, horizontally or under the cab.

The engine 12 is in fluid communication with the filter apparatus 10 through entrance tubing 14 at the inlet side of the filter apparatus 10. Treated exhaust flows from the filter apparatus 10 through exit tubing 16, which can include a tailpipe, at the outlet side of the filter apparatus 10.

Figure 2:
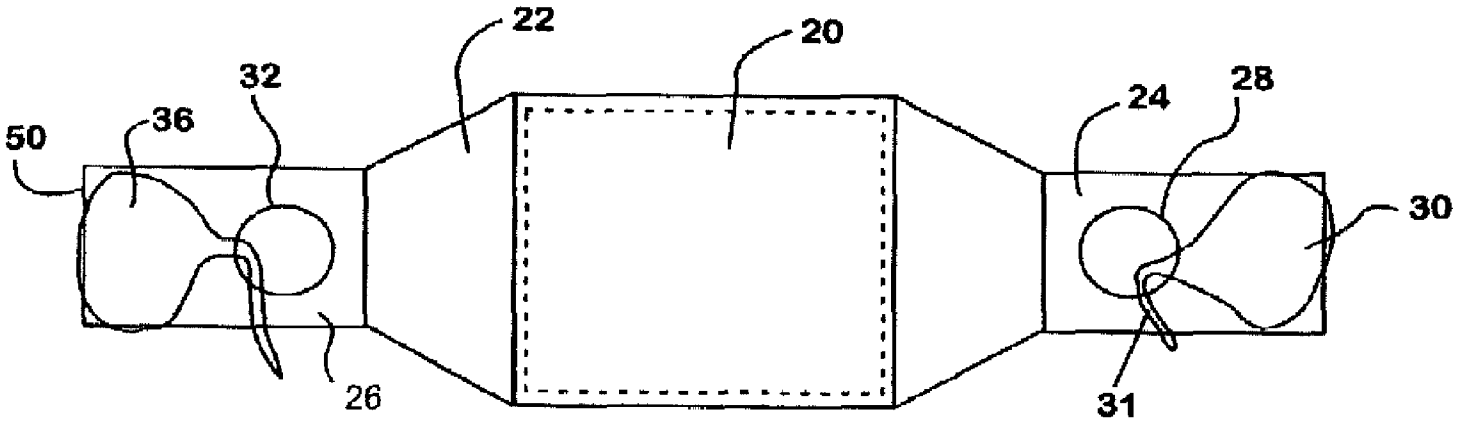
FIG. 2 is a partial cross-sectional view of a first embodiment of a filter apparatus and pressure wave generator of the invention.

As shown in FIGS. 1 and 2, the filter apparatus 10 has a housing 22 and a diesel particulate filter 20 disposed therein. The filter apparatus 10 may connect with a catalytic device 18 located between the engine 12 and the filter apparatus 10. The housing 22 has a first conduit 24 in fluid communication with the entrance tubing 14. The opposite second conduit 26 is in fluid communication with the exit tubing 16.

The first conduit 24 has a first port 28. An inflatable first bladder 30 is located within the first conduit 24 and is accessible through the first port 28. When inflated by pumping gas or air through the stem 31, the first bladder 30 closes off the housing from the catalytic device 18.

Pressure waves can be generated at the exit tubing 16 or second conduit 26 and transmitted into the housing 22. After inflating the bladder 30, pulses of compressed gas can be directed through the exit tubing 16 or second conduit into the housing 22. The pulses of compressed gas dislodge the ash particles from the diesel particulate filter 20. An ash collecting apparatus 84, such as a shop vacuum, can be inserted into the first port 28 to remove the dislodged ash particles.

A second port 32 can be located between the housing 22 and an exit opening 34 of the exit tubing 16, such as within the second conduit 26. An inflatable second bladder 36 is accessible through the second port 32. When inflated, the second bladder 36 closes off the housing 22 from the outside environment.

Pressure waves are introduced between the exit opening 34 of the exit tubing 16 and the housing 22. The pressure waves are generated from a gas line 38 introduced through the second port 32 after inflating the second bladder 36. The gas line 38 connects to a remote pressure wave generator 86, such as pulses of compressed gas from a tank or air compressor. A controller can control the amount, frequency and pressure of the gas pulsed into the filter apparatus 10. For the pressure wave, the gas should be at a high pressure, for example, about 20 psi to about 150 psi.

Alternatively, additional heat can be added to the housing 22 from a heat source through the first port 28 or second port 32 (not shown). A heat gun, water heater element, or propane flame can add heat through the first port 28 or second port 32. The additional heat augments the heat generated by the running engine.

Figure 3:
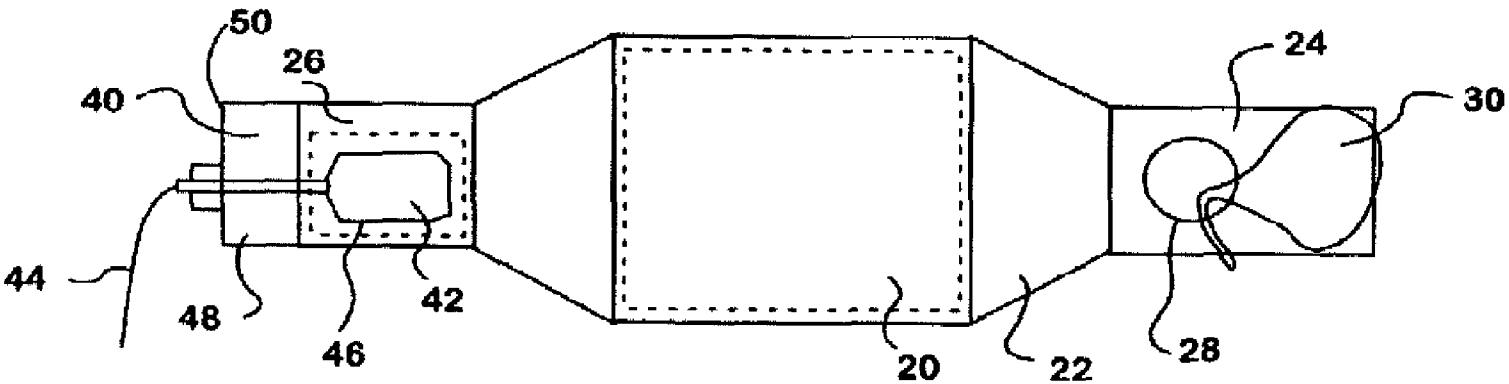
FIG. 3 is a partial cross-sectional view of a second embodiment of a filter apparatus and pressure wave generator of the invention.
Figure 4:
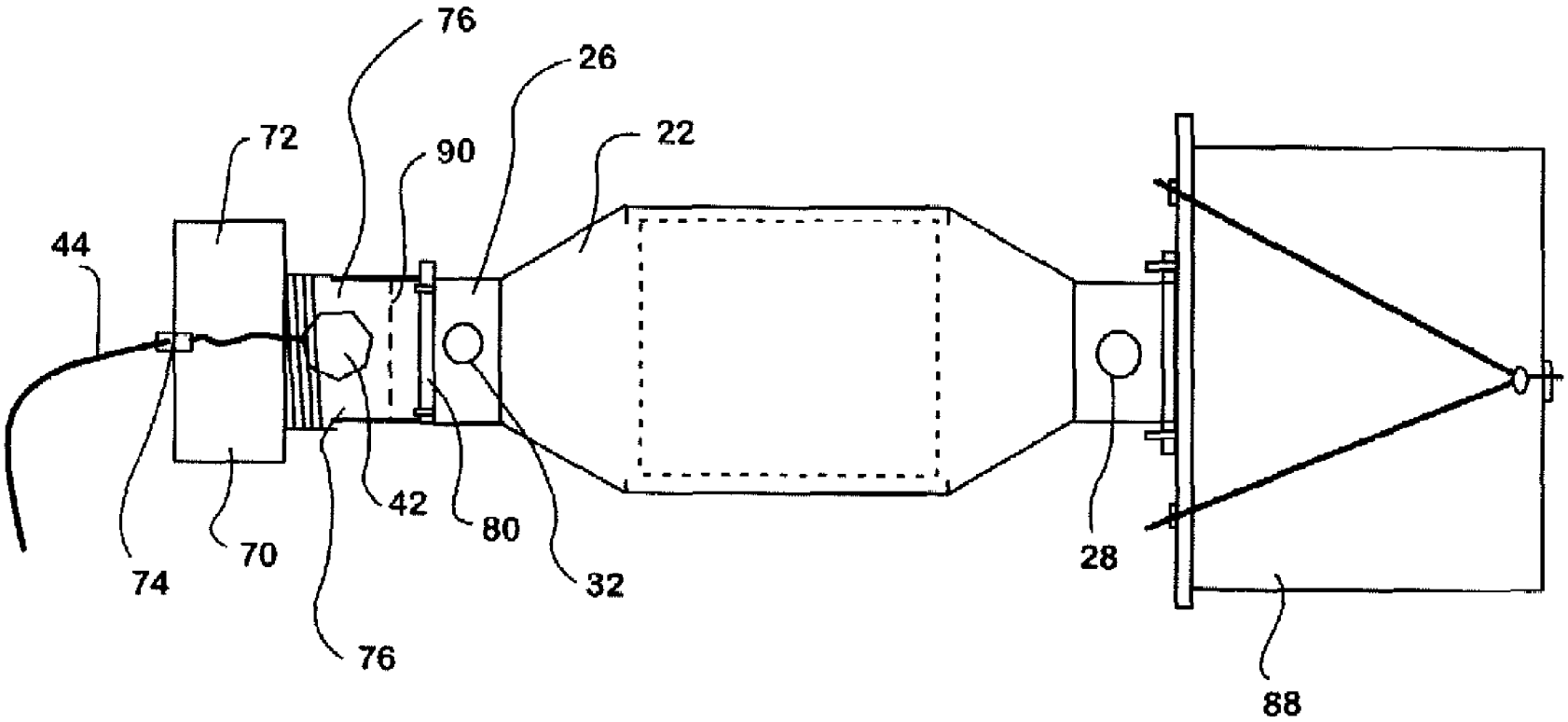
FIG. 4 is a cross-sectional view of a third embodiment of a filter apparatus and pressure wave generator of the invention removed from the motor vehicle.
Figure 5:
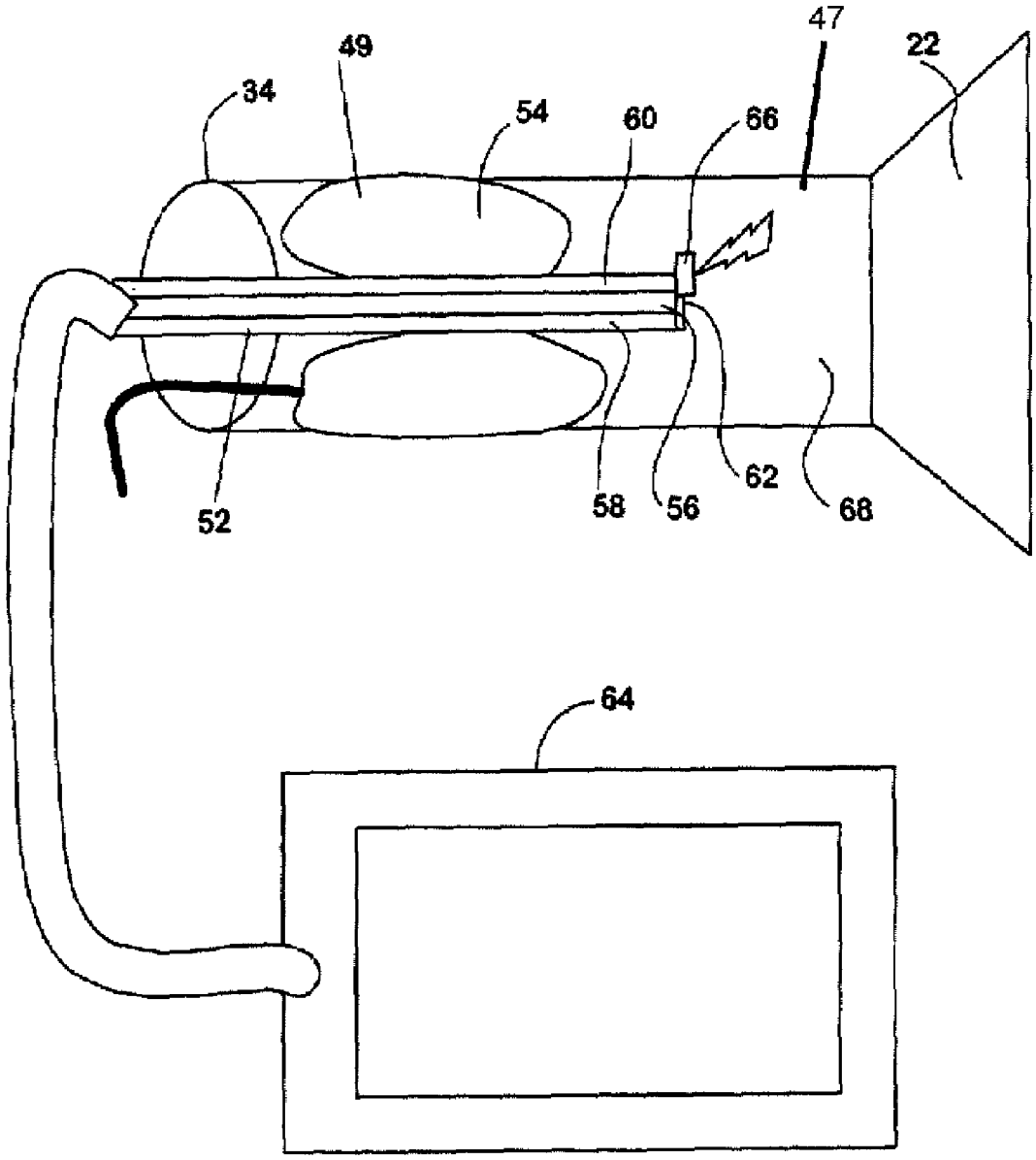
FIG. 5 is a partial cross-sectional view of a fourth embodiment of a filter apparatus and pressure wave generator of the invention.

Alternatively, pressure waves can be introduced by pressure wave generator 40 located between the housing 22 and the exit opening 34 of the exit tubing 16. As shown in FIGS. 3 and 4, pressure wave generator 40, 70 uses a vessel 42 in fluid communication with a gas line 44 attached to a source of gas, such as an air compressor or a gas tank. A stopper 48, such as a cap, plug, pipe cape 72 or inflatable bladder as shown in FIG. 5, closes the exit opening 50 of the second conduit 26 to form a chamber 47, with the gas line 44 inserted through the stopper 48. The stopper 48 can have a safety tether.

The vessel 42 can be located within the second conduit 26 after first disconnecting the exit tubing 16. Alternatively, the vessel 42 can be inserted into the second conduit 26 from the exit tubing 16 or used in the exit tubing 16. The vessel 42 is surrounded by a safety device 46, such as a cage, screen or a shield. The vessel 42 should be made from a stiff polymer having a known bursting pressure, such as polyethylene.

A pressure wave is generated by pressurizing the vessel 42 with the gas until the vessel 42 fails and bursts. The pressure wave generated should be about 100 psi to about 300 psi. The safety device 46 should contain any vessel debris. The gas source should be a high pressure air source, such as compressed air, an air compressor or compressed nitrogen. Preferably, the first bladder 30 is inflated within the first conduit 24 to protect the catalytic device 18 from any pressure waves.

FIG. 4 shows pressure wave generator 70 attached to the second conduit 26 after removing the exit tubing 16. The pressure wave generator 70 has a pipe cape 72 with a pass-through air fitting 74. A chamber 78 is defined by a cylindrical wall 76 extending between the pipe cape 72 and a flange 80 connected to the housing 22. A vessel 42 connects to a gas line 44 inserted through the pass-through air fitting 74. A screen 90 is placed inside the chamber 78 between the vessel 42 and the flange 80.

FIG. 5 shows pressure wave generator 52. A stopper 49, such as a cap, plug, pipe cape or inflatable bladder 54, forms a chamber 68 after inserting into the exit opening 34, 50 between the outside and the housing 22 to close at least part of the exit tubing 16 or second conduit 26. The bladder 54 surrounds a fuel line 56, a gas line 58 and an electrical line 60, all of which are threaded from the exit opening 34 of the exit tubing 16 or the exit opening 50 of the second conduit 26 after removing the exit tubing 16. The fuel line 56 and gas line 58 can end in a nozzle 62. The electrical line 60 extends between a controller 64 and an igniter 66, such as a spark igniter or piezoelectric igniter, with the igniter 66 located at or near the nozzle 62.

The controller 64 can include electronic controls for manual inputs or can be programmed for automatic control. The controller 64 can be in communication with pressure sensors located in the fuel line 56, the gas line 58 and the exit tubing 16 or second conduit 26.

The fuel can be any fuel that ignites such as propane or other aerosols and can be pressurized. The gas is an oxygen source, is preferably compressed and can be air.

A cycle of pressure wave generation starts after the bladder 54 shown in FIG. 4 is inflated. Then, gas is added to the chamber 68 through gas line 58. After oxygen in the chamber 68 reaches a desired level, fuel starts to flow through the fuel line 56 to the nozzle 62. The fuel is ignited by the igniter 66 which causes an explosion. The explosion generates a pressure wave which passes through the second conduit 26 and into the housing 22. Additional pressure waves can be generated by repeating the cycle.

The controller 64 can control the cycle by controlling the delivery of gas, fuel and ignition. After oxygen reaches a level between the bladder 54 and the housing 22, the controller 64 can stop the flow of gas. The controller 64 can next start the fuel flow and ignite the igniter 66. The controller 64 can switch on the ash collecting apparatus 84 for removing the ash particles after igniting the fuel. Once the pressure drops in the chamber 68 after the explosion, the controller 64 can restart the cycle.

The ports 28, 32 are normally plugged during normal operating conditions. When the diesel particulate filter needs cleaning, the plugs are removed from the ports to allow cleaning and inflation of the bladders.

The diesel particulate filter 20 and its housing 22 can also be removed from the vehicle and cleaned using the pressure waves. As shown in FIG. 4, the diesel particulate filter is removed and attached to pressure wave generator 70. A filtering apparatus 88 is attached to the first conduit 24 to filter ash and debris during the cleaning.

The method of the invention has a number of advantages. By leaving the diesel particulate filter attached to the chassis, the filter handling requirement for this method is reduced and thus has a lower risk of damage to the filter. Yet if desired, the filter can be removed from the vehicle and cleaned using the method of the invention.

The method is economical. The equipment used to clean the diesel particulate filter is readily available in a service shop.

While the invention is shown in only one of its forms, it is not thus limited but is susceptible to various changes and modifications without departing from the spirit and scope of the invention.

What is claimed is:

1. A filter apparatus for a motor vehicle with an engine, comprising:

a housing;

a first conduit extending from the housing and being in fluid communication with the housing;

a second conduit extending from the housing and being in fluid communication with the housing;

a first port in the first conduit;

an exit opening between the second conduit and the outside environment;

a second port being located between the housing and the exit opening;

an inflatable bladder being located within one of the conduits and capable of being accessed through one of the ports;

a diesel particulate filter being located within the housing;

a pressure wave generator in fluid communication with the second conduit, wherein the pressure wave generator further comprises:

a chamber being located between a stopper and the housing;

a vessel located in the chamber;

a gas line connecting to the vessel; and a safety device between the vessel and the housing.

2. A filter apparatus for a motor vehicle with an engine of claim 1, further comprising:

a second inflatable bladder being located between the exit opening and the housing.

* * * * *